US011801435B2

(12) United States Patent
Azzolin

(10) Patent No.: US 11,801,435 B2
(45) Date of Patent: Oct. 31, 2023

(54) PROTECTION DEVICE AND RELATED METHOD OF USE

(71) Applicant: DAINESE S.P.A., Colceresa (IT)

(72) Inventor: Andrea Azzolin, Colceresa (IT)

(73) Assignee: DAINESE S.P.A., Colceresa (IT)

( * ) Notice: Subject to any disclaimer, the term of this patent is extended or adjusted under 35 U.S.C. 154(b) by 549 days.

(21) Appl. No.: 17/017,251

(22) Filed: Sep. 10, 2020

(65) Prior Publication Data

US 2021/0077889 A1 Mar. 18, 2021

(30) Foreign Application Priority Data

Sep. 17, 2019 (IT) ..... 102019000016538

(51) Int. Cl.
*A63B 71/08* (2006.01)
*A41D 13/05* (2006.01)

(52) U.S. Cl.
CPC ..... *A63B 71/081* (2013.01); *A41D 13/0512* (2013.01); *A63B 2209/00* (2013.01); *A63B 2220/56* (2013.01); *A63B 2220/833* (2013.01); *A63B 2225/62* (2013.01); *A63B 2243/007* (2013.01)

(58) Field of Classification Search
CPC ..... A63B 71/081; A63B 2225/62; A63B 2220/833; A41D 13/0512
See application file for complete search history.

(56) References Cited

U.S. PATENT DOCUMENTS 5,168,576 A * 12/1992 Krent ..... A41D 13/0156 2/463
5,362,098 A * 11/1994 Guill ..... B64D 25/00 244/122 AG
9,332,794 B2 * 5/2016 Mazzarolo ..... A41D 13/0512
2021/0076759 A1 3/2021 Azzolin

FOREIGN PATENT DOCUMENTS

| | | | | |
|---|---|---|---|---|
| EP | 2329732 | A3 * | 9/2011 | ..... A41D 13/0155 |
| EP | 3167730 | A1 | 5/2017 | |
| EP | 3795019 | A1 | 3/2021 | |
| EP | 3847917 | A1 * | 7/2021 | ..... A41D 13/018 |
| IT | 201900016547 | A1 | 3/2021 | |
| IT | 201900016553 | A | 3/2021 | |
| JP | 6045209 | B2 | 12/2016 | |
| WO | 2010/067288 | A1 | 6/2010 | |
| WO | 2016/178143 | A1 | 11/2016 | |
| WO | 2017/163196 | A1 | 9/2017 | |
| WO | WO-2021260002 | A1 * | 12/2021 | |

* cited by examiner

*Primary Examiner* — Tajash D Patel
(74) *Attorney, Agent, or Firm* — Steinfl + Bruno LLP

(57) ABSTRACT

Protector for an American football player, including, as impact absorption device, an inflatable element defining an inner chamber adapted to receive an inflation fluid and adapted to assume an active inflated condition. Use of an inflatable element as a protector for an American football player and a method for protecting an American football player are also described.

16 Claims, 4 Drawing Sheets

PROTECTION DEVICE AND RELATED METHOD OF USE

CROSS REFERENCE TO RELATED APPLICATIONS

The present application claims the priority of Italian patent application No. 102019000016538, filed on Sep. 17, 2019, which is incorporated herein by reference in its entirety.

FIELD

The present disclosure relates to a method for protecting an American football player and a protector for an American football player.

BACKGROUND

The term "American football" is used to indicate a game which is popular in the USA (simply referred to as "football" in the USA). For example, the game is at the moment defined by the rules and regulations which are applied by the National Football League. The expression "American football player" indicates a player which may be involved in a game of American football (or simply "football") which complies with the playing rules of this discipline.

The author of the present disclosure has noted that at present the protectors for protecting an American football player use a rigid structure with plates which forms a kind of armor underneath the players jersey and is very heavy and bulky.

SUMMARY

A technical problem underlying the present disclosure is that of providing a method for protecting an American football player and a protector for an American football player, which has small dimensions or which is the least bulky possible and which may also be the lightest possible for the player and adapted to the human anatomy.

Said technical problem is solved by a method for protecting an American football player and a protector for an American football player according to the respective independent claims. Further characteristic features are defined in the respective dependent claims.

In particular, in accordance with the present disclosure, in order to protect the American football player a protector for an American football player is provided where the energy absorption function is performed by an inflatable element. No external armor or additional external protective plate structures are envisaged; namely there is no separate armor nor any protective plates in addition to the inflatable element. Basically, the inflatable element alone in the inflated condition performs the energy absorption function.

The inflatable element is inflated by means of inflation means of the known type, such as manually operated or electronically controlled inflation means. The inflation means may be a compressor able to introduce an inflation fluid into the inflatable member so as to reach pressures suitable for ensuring effective protection of the player and compliance with impact tests. The inflation therefore is such that it is able to keep the inflatable element in the inflated condition during use.

Preferably a pressure sensor may be provided so that the pressure inside the inflatable element may be continuously controlled, or controlled at predetermined times, and the player preferably alerted when the pressure of the inflatable element is no longer sufficient.

The protector consists of a protector in which the inflatable element, in the inflated condition, independently performs the impact protection function. The inflatable element in the inflated condition may also be configured so as to cover, like a rigid armor, the players body.

The inflatable element covers preferably part of the chest, like the classic plate-type armor of the prior art worn by a football player, and therefore remains in the inflated condition during use in order to perform the protection and energy absorption function.

The inflatable element may be provided with possible reinforcing layers on an outer side or with layers which are resistant to cutting and abrasion so as to be able to perform the function of an independent protector.

Preferably, the inflatable element has a curved form or curved profile at least in the inflated condition which is adapted to the form of the American football players body. In other words, the inflatable element has a concavity in the inflated condition facing the player's body so as to adapt to the anatomy of the players body and substantially surround the players body or follow the anatomy of the player's body.

Preferably, in order to obtain the curvature or shaping of the inflatable element, opposite portions of the inflatable element are structured or configured so that there is a difference between the expansion of the inner side facing the user and the expansion of an outer side opposite the inner side. The difference in expansion is obtained preferably by varying the yielding capacity of the inner side of the inflatable element with respect to the yielding capacity of the outer side.

As a result, in the inflated condition the inflatable element may have an inner side which is more rigid and expands less (namely a side which is less yielding, i.e. a side which gives way less when the inflatable element is inflated and reaches the inflated condition) and an outer side which inflates and expands more (namely a side which is more yielding, i.e. a side which gives way more when the inflatable element inflates and reaches the inflated condition).

Even more precisely, and preferably, in accordance with one of the embodiments of the present disclosure, the inflatable element includes a textile structure formed by two opposite meshes or mesh portions and tie threads having a first end connected to a first mesh or first mesh portion and a second end connected to a second mesh or second mesh portion.

Even more particularly, the textile structure may be made from a knitted body having at least a tubular form, or preferably a bag-like form with an access opening or the form of a closed casing or ball. The knitted body has, inside it, tie threads which connect substantially opposite portions of the knitted body and are tensioned when the kitted body is inflated.

The knitted body is covered by, or included in a region between, a first wall and a second wall which are connected or respectively joined along the respective edges.

The walls may be made of a suitable material resistant to abrasion or cutting, such as a layer of carbon fiber, Kevlar, etc.

In other words, the inflatable element includes a knitted body, i.e. a body made by means of a knitting operation. Said knitted body is a closed structure obtained by means of knitting, or at least tubular structure, defining an inner region or area or chamber. This inner chamber is occupied partially by a plurality of joining threads which connect together opposite portions of the knitted body. The fact of providing a single knitted body has the advantage of limiting the manufacturing waste and minimizing the production time; in fact, the joining threads and meshes may be processed using a single knitting machine. The joining threads form part of single thread connected to the opposite portions of the knitted body. In particular, the thread passes along alternate sections, or continuously, between a first portion and a second portion of the knitted body.

Preferably, the inflatable element further includes sealing walls which allow the inflation fluid to be contained for a predetermined period of time. The walls consist, for example, of a first sheet, or first wall, and of a second sheet, or second wall, which are fixed together along respective perimetral edges. Said first and second sheets cover and line the knitted body on an outer side or outer surface. Said first wall and said second wall may be made of material which is resistant to abrasion and/or cutting.

Even more preferably, in an edge zone of the inflatable element, the tie threads have a smaller length compared to the density of a central zone of the inflatable element.

Even more preferably, in an edge zone of the inflatable element, the tie threads have a greater density compared to the density of a central zone of the inflatable element.

In this way in the edge zones, where the inflatable element usually has a rounded profile, in order to follow a design adapted to the shape of the human body, the greater quantity of tie threads may offset the different yielding capacity of the outer side of the inflatable element with respect to the inner side. In this way, in the edge zone, the inflatable element may have a curved profile which is even more controlled. In other words, it is possible to control the curvature of the bag also along the edge.

Even more preferably, the tie threads are arranged in rows, and even more preferably, extend in a radial manner from the edge zone towards the center of the inflatable element, for example from an edge around the neck towards the respective shoulders, or from each shoulder towards the edge of the neck. This radial arrangement is able to control the expansion of the inflatable element in a sagittal direction of the inflatable element, namely from the rear towards the front or vice versa.

In other words, by organizing the threads with a varying density between an edge zone or peripheral zone of the inflatable element and a more central zone it is possible to adjust in an optimum manner the curvature of the bag and further adjust the curvature of the bag in response to the curvature determined by the different yielding capacity. In other words, a variation of the density of the threads, greater in the edge zone than in the central zone, is able to offset the varied yielding capacity of the outer side of the inflatable element. A better curvature is obtained. This advantage is particularly useful when the edge extends in a sagittal direction S of the human body from the front to the rear and vice versa.

For example, in a neck zone or zone around the shoulders, the inflatable element has an anatomical curvature, namely has an anatomical curved profile which surrounds the neck and the respective shoulders. Since the edge has a greater concentration of tie threads, it is possible to control the curvature along this edge. This advantage is increased even further by the radial arrangement of the threads. In fact, by providing the radial arrangement so that an ideal starting point of the radial arrangement is situated at the center of the curve of the edge, for example the curve which surrounds the neck, it is possible to obtain a controlled curvature of the inflatable element in the direction of the curve of the neck, i.e. in the curved direction of the profile of the inflatable element around the neck. In fact, the radial arrangement starts from the center of the neck with rows of threads which extend radially towards the respective shoulder. Similarly, it is possible to obtain this effect in the curved zone of the shoulders, by providing a radial arrangement of threads which ideally starts from an outer point of the bag on the outside of the shoulder, with rows of threads which extend radially towards the neck.

The radial arrangements are symmetrical with respect a sagittal mid-plane of the user's body.

Preferably, the tie threads are not simply interwoven with the mesh portions of the knitted body. In particular, if the knitted body is regarded as being a mesh including a plurality of mesh units, each tie thread forms one or more knots with one or more respective mesh units of the knitted body. In other words, the tie thread is not simply interwoven with the mesh unit, but is knotted together with the mesh unit and the knot is tightened when inflation is performed. In this way, the knot stops any movement of the knitted body with respect to the tie threads and allows even better control of any unexpected behavior of the knitted body during inflation.

Other advantages, characteristic features and modes of use of the subject of the present disclosure will emerge more clearly from the following detailed description of a number of preferred embodiments thereof, provided by way of a non-limiting example. It is nevertheless evident that each embodiment may have one or more of the advantages listed above; in any case it is nevertheless not necessary that each embodiment should have simultaneously all the advantages listed.

BRIEF DESCRIPTION OF THE DRAWINGS

Reference will now be made to the figures in the attached drawings in which.

DETAILED DESCRIPTION

Figure 1:
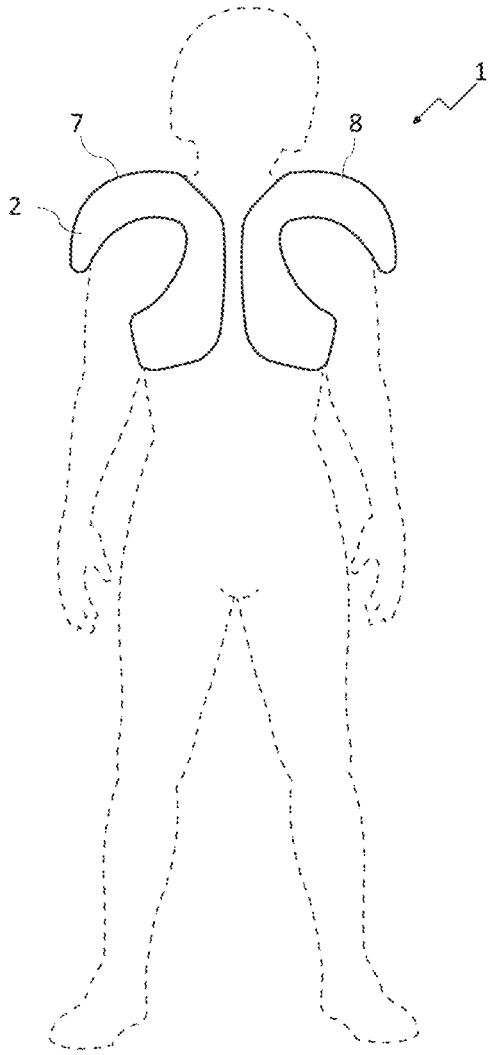
FIG. 1 shows a front view of a protector for an American football player according to an embodiment of the present disclosure in the condition when worn.
Figure 2:
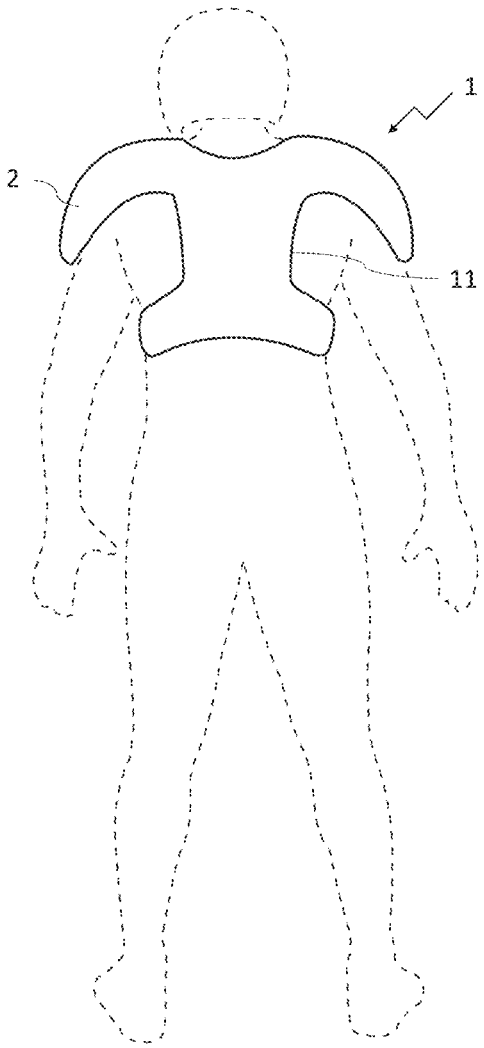
FIG. 2 shows a view, from the rear, of the protector for an American football player according to FIG. 1.

With reference to the accompanying figures, the reference number 1 indicates a protector for an American football player according to the present disclosure in accordance with an embodiment of the present disclosure.

In particular, the protector 1 for an American football player comprises an inflatable element 2 which is formed in the manner of a casing and inside which an inner chamber 3 is defined. The inflatable element 2 is able to assume substantially a first rest condition, or deflated condition, and a second active condition, or inflated condition. The modes of inflating the inflatable element 2 will be described in the description below.

According to the present disclosure the inflatable element acts as an energy absorption element and preferably additional external plates are not provided. This is because the protection offered by the inflatable element in the inflated condition is sufficient for ensuring the necessary protection for an American football player. More particularly, the inflatable element may be made using the technology described in the Italian patent applications 102019000016547 and 102019000016553, international application WO2017/163196A1, WO2016/178143A1 and WO2010/067288 A1, or in European patent application EP3167730A1, each of which is incorporated herein by reference in its entirety.

In the example of embodiment shown, the inflatable element 2 is suitably cut to shape so as to be placed on the upper zone of the chest of a user, in compliance with the American football regulations. For this purpose and by way of example, the inflatable element 2 has a form comprising two side wings 7, 8 for covering the shoulders of the American football player, a central portion shaped substantially in the form of a "C" 10 and a spine portion 11 intended to protect the backbone of the user.

According to a preferred aspect, the inflatable element 2 comprises a plurality of tie members 5 distributed inside the inner chamber 3 and stably connected to respective portions of the inflatable element 2. The term "tie member 5" is understood as meaning an element or part which has the function of keeping joined together, or fastened or fixed, by means of tensile force, two or more parts of the inflatable element 2, at least when the latter is in the inflated condition.

In the example, the tie members 5 have a thread-like form and are flexible and inextensible elements. Therefore, they are suitably designed with dimensions such that, when the inflatable element 2 is in the rest condition, they are preferably not subject to tensioning and are collapsed inside the inner chamber 3, whereas when the inflatable element 2 is in the inflated condition they are tensioned.

The inflatable element comprises opposite walls 15, 16 perimetrally joined together along the edges 20, 21. More particularly, the inflatable element 2 comprises a textile structure 40 comprising the aforementioned tie members 5 and two opposite mesh portions 18, 19, each of which lines internally, namely on the inner chamber side 3, a respective wall 15, 16. Basically, a textile structure 40 formed by at least two mesh portions 18, 19 is arranged inside the zone between the two walls 15, 16 and each mesh portion is preferably fixed to the respective wall 15, 16.

Even more particularly, in order to provide the inflatable element with structural stability, each mesh portion 18, 19 is stably fixed to the surface of the respective wall 15, 16, preferably by means of a film of glue or layer of glue.

Owing to the textile structure 40 with mesh portions and tie members and walls, the inflatable element 2 may reach high pressures able to create a suitable energy absorption cushion for the American football player.

According to a preferred aspect of the present disclosure, the inflatable element 2 has a curved shape which follows the anatomy of the human body.

Preferably, in order to obtain a curvature of the inflatable element 2 in the inflated condition, the first wall 15 and the second wall 16 have, in the inflated condition, a surface area which is different from each other, for example the second wall 16 has a surface area smaller than that of the first wall 15, and is made of a material which is less elastic or less yielding. The first mesh portion 18 and the second mesh portion 19 are made of the same material. The two outer walls are made of a material with a different yielding capacity. Consequently, when inflated, the bag yields in different ways.

For example, the first wall 15 may be made with a yarn different from the yarn of the second wall 16, respectively, for example a more elastic or yielding material. The different yarns are not illustrated in the drawings. Alternatively or in combination with this latter embodiment, the two opposite mesh portions also have a different yielding capacity.

In one embodiment, for example, the first mesh portion 18 and the second mesh portion 19 have, in the inflated condition, surface areas which are different from each other, for example the second mesh portion 19 has a surface area or expansion capacity smaller than that of the first mesh portion 18. In order to obtain this different surface area the second mesh portion may be made of a material less elastic or less yielding (more resistant to traction) than the first mesh portion 18.

Alternatively again, the second mesh portion 19 and/or the second wall 16 may be made using the same material, but with a denser weave than the first mesh portion 18 and/or than the respective first wall 15 during knitting and therefore have a smaller expansion capacity than the first mesh portion 18 or first wall. The different mesh affects the different yielding capacity of the two parts.

Each of the two walls 15, 16 or sheets may be made preferably of any material suitable for ensuring resistance to abrasion and/or cutting.

As mentioned above, in the example, the tie members 5 are flexible tie members and have the form of threads and are made for example of polyester or polyamide, with a thickness of between about 500 and about 1000 decitex (units of length of a continuous thread or a yarn) and have ends 5*a*, 5*b* which are fixed to the respective wall portions 15, 16 which they connect. Even more particularly, each tie member or thread 5 includes a bundle of continuous untwisted fibers which emerge from a single point of a respective mesh portion 18, 19.

The tie members 5 have opposite ends 5*a*, 5*b* which are stably fixed to the mesh 18, 19 of the respective wall 15, 16. The fixing at the opposite ends 5*a*, 5*b* of the tie members 5 is, for example, obtained by means of simple insertion of tie members 5 between the weaves of the mesh portion 18, 19. Basically, in the example shown in the figures, the tie members 5 are obtained by means of a given number of threads which are fixed alternately to one mesh portion 18 and consecutively to the other mesh portion 19. In other words, each thread 5 is inserted below a weave of the mesh portion 19 of the wall 16, is curved upwards and extends again towards the opposite wall 15, where it is connected in the same way to the mesh portion 18. Alternatively, the tie members 5 are connected to the mesh portion 18, 19 by means of interweaving or by means of tying or similar fixing systems.

The tie members may have a length which is smaller in the edge zone 20, 21 of the inflatable element 2, namely which may decrease in the direction from a central zone towards the edge of the inflatable member 2.

Preferably, each tie member is fixed to the respective mesh portion by means of a knot which allows fastening of the tie thread to the respective mesh portion during inflation and allows even better control of the expansion and the form of the inflatable element in the inflated condition. The mesh portions 18 and 19 may also be made of polyester or polyamide.

Even more preferably, the mesh portions 18 and 19 form part of a knitted body 50. In the embodiment shown the knitted body 50 is a tubular body and even more preferably substantially with a bag-like form which may have only one access opening allowing access to the inner zone 3.

The knitted body 50 therefore includes, when extended on a surface and flattened in this extended portion, two opposite mesh portions 18, 19 and at least three lateral mesh portions 55, 56, only two of which can be seen and which extend continuously between the two mesh portions 18, 19.

The knitted body 50 has a shape which reproduces and follows the shape of the inflatable element 2 and is formed as a single body according to said shape so as to define a single inner zone 3.

The knitted body 50 includes moreover the aforementioned tie members 5 which are worked together with the knitted body.

In order to obtain a protector for an American football player which has the best possible shape adapted to the human body, opposite portions of the inflatable element 2 in addition to having a different expansion capacity, or different yielding capacity, also offer further control of the form of the inflatable element.

Figure 3:
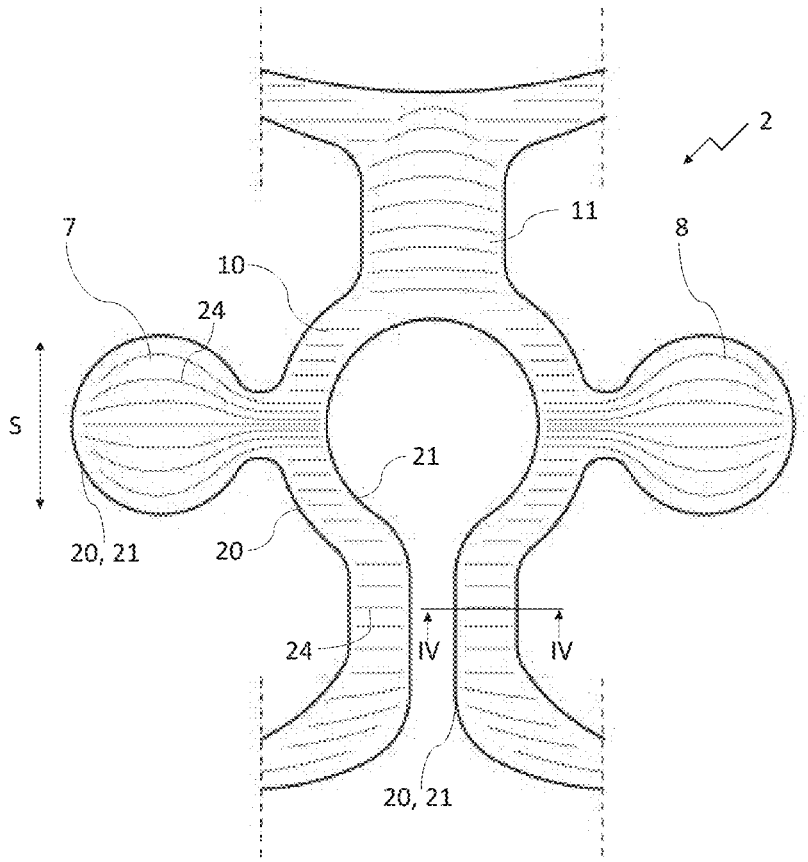
FIG. 3 shows a plan view of the protector for an American football player according to FIG. 1.
Figure 4:
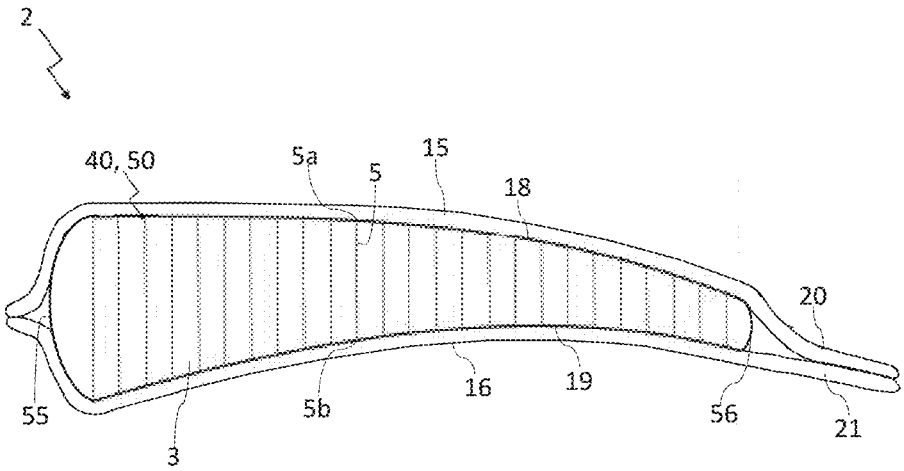
FIG. 4 shows a cross-sectional view along the line IV-IV of FIG. 3.

In particular, according to an aspect of the present disclosure, in the edge zone of the inflatable element 2, the tie members are more densely concentrated than in a central zone of the inflatable element. The greater density of the threads (not shown in the drawings) offsets, in the edge zone 20, 21, the greater expansion of the outer side of the inflatable element and allows the formation of a curvature suitable for the edge zone of the inflatable element 2. For example, in the edge zone, the inflatable element 2 has a curved profile which follows the anatomy of the human body. For example, as can be seen in FIG. 3, the edge follows the profile of the neck or follows the profile of the shoulder. By arranging a greater concentration of threads in the edge zone, it is possible to offset a greater expansion of the bag in the edge zone on the outer side in the sagittal direction S (namely from the front towards the rear and vice versa) and allow therefore adjustment of the curvature of the bag also in the sagittal direction S.

Even more preferably, the tie threads are arranged in rows (schematically indicated by the number 24 in FIG. 3) and the rows 24 are arranged radially from the end edge 20, 21 of the inflatable element 2 and expand, moving away from each other, towards the center of the inflatable element 2. This radial arrangement allows further control of the shape of the bag, in particular in the neck zone and shoulder zone.

In connection with the knitted body 50, the following comments may also be made:

The tie thread 5 is an element or part which has the function of keeping joined together, or fastened or fixed, by means of a tensile force, two or more parts of the knitted body 50, at least when the latter is in the inflated condition. It is pointed out that, in the embodiment shown, a plurality of tie threads 5 are obtained from, or form part of, a single thread or a single filament composed of at least two threads, wherein the single thread or the single filament extends alternately continuously between the first portion 50 and the second mesh portion 19 of the knitted body 50.

Even more particularly, the single thread or the single filament is arranged in a zig-zag or with a sinusoidal progression between the first mesh portion 18 and the second mesh portion 19 of the knitted body 50 so as to cover or occupy a region of the inflatable element 2. Each tie thread 5 is worked together with the knitted body.

The tie threads 5 are suitably designed with dimensions such that, when the inflatable element 2 is in the rest condition, they are preferably not subject to tensioning and are collapsed inside the inner chamber 3, whereas when the inflatable element 2 is in the inflated condition they are tensioned. The threads may be arranged so as to connect opposite portions 18, 19 of the knitted body 50 or may be arranged diagonally so as to connect portions of the knitted body 50 which are not situated perfectly opposite each other.

In an embodiment of the present disclosure, the yarns used to make the tie threads 5 are yarns different from those used to make the mesh portions 18, 19. In particular, the tie threads are made of a material having a greater tensile strength than the threads of the casing body. The threads of the casing body may be made of a softer material so as to obtain an inflatable element which may be as soft as possible and with a light and flexible consistency which may ensure maximum comfort for a user wearing it.

The threads of the knitted body 50 may be made of a variable material which differs also depending on the zone of the protector in which they are located and the zone of the user's body to be protected.

The knitted body 50 and the tie threads 5 may be made using a knitting machine, or a flat knitting machine of the known type which includes two needle beds, namely two rows of needles intended for working the knitted body. A knitting machine of the known type is a glove-making machine such as that identified by the code SWG0991N of Shima Seiki.

The two needle beds have a series of needles with an extension or length which corresponds to a shape dimension, for example shape width or length, of the inflatable element to be obtained, corresponding to one of the two mesh portions 18, 19 comprised between the portions 55, 56 for example. The machine is provided with a first thread guide supporting a first thread intended to form the knitted body 50 and a second thread guide which has a second thread intended to form the tie threads 5.

The machine may be programmed so as to produce the knitted body 50 by means of the first thread guide which works alternately the thread on the first needle bed and on the second needle bed.

The machine may be programmed so as to join together two opposite zones 18, 19 of the knitted article by means of the second thread mounted on the second thread guide, in order to form the tie threads 5. For example, the machine may be programmed to work a number of mesh rows, so as to form a number of complete mesh turns, and then join together, by means of the second thread guide, and therefore the second thread, certain needles of the first needle bed with certain needles of the second needle bed. Then, a few mesh turns may again be worked and the knitting with the second thread which forms the tie threads repeated.

In order to define a specific length of the joining thread it is possible to join together the meshes by means of diagonal tie threads. In this case, the second thread guide interweaves the thread intended to form the tie thread with certain needles of the first needle bed and the second needle bed so that the tie threads are arranged diagonally between the needles of a first needle bed and the needles of a second needle bed.

Alternatively, it is possible to work the mesh using a "needle drop" technique where, for each needle bed, some needles are used as "operative" needles intended to perform knitting and are therefore involved in the knitting of the meshes of the knitted body, and others as "non-operative" free needles which are not involved in the knitting. These "non-operative" needles which are kept free are able to receive temporarily the joining thread. Basically, the joining thread is "parked" momentarily on the "non-operative" needle when it is it is being worked between the first needle bed and second needle bed. in particular, the joining thread is used for knitting on an "operative" needle of the first needle bed intended to work the meshes, is then "parked" on a "non-operative" needle of the same first needle bed and is then worked on an "operative" needle of the second needle bed. In this way, by programming the distance between the first "operative" needle of the first needle bed, the non-operative needle of the first needle bed and the "operative" needle of the second needle bed, it is possible to establish a priori the length of the tie threads 5 when the knitted body is removed from the knitting machine.

It is to be understood that a person skilled in the art of using flat knitting machines may be able to program the machine in the best possible manner for obtaining the desired result.

In particular, in order to obtain an asymmetry or different yielding capacity of the first mesh portion 18 and the second mesh portion 19, the knitting machine is programmed to obtain a different weave for the first mesh portion 18 and the second mesh portion 19, or a third thread guide may be used in order to form the portion 18 using a yarn different from that of the portion 19.

Further information regarding the processing of a knitted body using tie threads may be found in the Italian patent application TO-2013-A-472 which is incorporated herein by reference in its entirety and describes the manufacture of knitted bodies provided with tie threads.

It is pointed out moreover that the flat knitting machine may also be programmed to vary the length of the joining thread depending on the zone of the inflatable element to be produced. For example, in a zone of the knitted body 50 intended to be arranged in the perimetral zones or portions 55, 56 of the inflatable element 2, the tie threads 5 may have a length which gradually decreases gradually to a minimum value, in order to ensure tensioning of the tie threads 5 also in the perimetral zones when the inflatable element 2 is inflated.

Moreover, the flat knitting machine may also be programmed to vary the mesh opening, for example by modifying the programming of the needle drop, or when a denser mesh is required, by using a double thread to form the mesh.

An important advantage resulting from the fact the knitted body 50 is obtained in a single working operation is that it is not required to provide perimetral stitches in the meshes as instead was necessary in the preceding embodiment.

The protection device described above is made in the manner described below in accordance with an embodiment.

The knitted body 50 is arranged in an extended condition so that the two opposite portions 18, 19 are collapsed on top of each other. The knitted body 50 is in this configuration arranged between two walls 15, 16 and fixed so as to adhere to a respective portion, for example by means of glue.

Then respective, opposite, perimetral edges 20, 21 of the walls 15 and 16 are superimposed on each other along the perimeter.

From the above description it can be understood that the two walls 15 and 16 are essentially two elements or sheets of the inflatable element 2 situated opposite each other and fixed along the respective perimetral edges. It is possible in any case for the two walls 15 and 16 to be opposite portions of a single sheet with a book-like fold and therefore having peripheral edges extending along a portion of the perimeter.

It is also pointed out that the protector for an American football player is arranged underneath a normal American football outfit or jersey without any additional armor. Connecting structures, such as straps, elastic belts or other fixing structures may be provided for connecting together the portions of inflatable element in the chest zone or for fixing them on the shoulders.

Alternatively or in combination with said embodiments, the inflatable element may be included inside a jersey of the American football player.

In order to perform inflation of the inflatable element 2 it is possible to use inflation means for introduction of an inflating fluid inside the inflatable element. These inflation means may comprise gas generators of the known type, such as a pressurized gas compressor or canister. The pressurized gas generator may also be a manual pump. A pressure sensor may control the pressure inside the inflatable element.

It is advantageous to provide a deflation valve in order to empty rapidly the inflatable element at the end of a training session or at the end of a game.

The subject-matter of the present disclosure has been described hitherto with reference to preferred embodiments thereof. It is to be understood that other embodiments relating to the same inventive idea may exist, all of these falling within the scope of protection of the claims which are attached below.

The invention claimed is:

1. A method for protecting an American football player, said method comprising:

providing at least one inflatable element, the inflatable element defining an inner chamber configured to receive an inflation fluid, the at least one inflatable element configured to assume an active inflated condition for impact absorption, arranging the at least one inflatable element on a body of the American football player, and inflating the at least one inflatable element into said active inflated condition and keeping the at least one inflatable element in the active inflated condition during use, wherein in the active inflated condition the at least one inflatable element acts as an impact absorption element for protecting the American football player;

wherein said inflatable element assumes a curved configuration in said active inflated condition by defining a concavity, the concavity facing the body of the American football player;

wherein the inflatable element includes a first face having a lesser expansion capacity and lesser yielding capacity on a side facing the American football player, and an opposite second face having a greater expansion capacity and greater yielding capacity on an opposite side to the American football player, wherein the lesser yielding capacity of the first face is with respect to the yielding capacity of the second face; and wherein i) the inflatable element includes a plurality of tie members distributed in the inner chamber, a first wall and a second wall opposite each other and connected along a perimeter, a first mesh portion, wherein the first mesh portion internally lines at least partially said first wall, and a second mesh portion, wherein the second mesh portion internally lines at least partially said second wall, ii) said plurality of tie members have ends fixed to said first mesh portion and to said second mesh portion, iii) said first mesh portion and the first wall at least partially define the second face of the inflatable element, and iv) said second mesh portion and the second wall at least partially define said first face of the inflatable member.

2. The method according to claim 1, the inflatable element is devoid of plate armor or protective plates and acts in the active inflated condition as the only absorption element to protect the American football player.

3. The method according to claim 1, wherein said second wall has said lesser expansion capacity and lesser yielding capacity and said first wall has said greater expansion capacity and greater yielding capacity or vice versa.

4. The method according to claim 3, wherein the inflatable element includes a knitted body, said knitted body having a structure closed on at least four sides, and wherein said first mesh portion and said second mesh portion are part of said knitted body.

5. The method according to claim 4, wherein the inflatable element comprises one or more zones arranged more adjacent to a free edge region of the inflatable element and wherein said one or more zones comprise a concentration of tie members per unit area greater than a concentration of tie members per unit area of a region further away from the free edge region or a more central region of the inflatable element.

6. The method according to claim 5, wherein the tie members are arranged between said first mesh portion and said second mesh portion and are aligned in a plurality of rows of tie members.

7. The method according to claim 6, wherein each row of tie members extends from a zone of the one or more zones arranged more adjacent to the free edge region towards the more central region.

8. The method according to claim 7, wherein a plurality of rows of tie members are arranged at least partially in a radial arrangement in said inflatable member starting from the zone arranged more adjacent to the free edge region.

9. The method according to claim 8, wherein peripheral edges of the inflatable element follow a curved profile.

10. The method according to claim 9, wherein the radial arrangement starts from an edge of a neck area and expands towards a respective shoulder area of the inflatable element.

11. The method according to claim 10, wherein each tie member forms a knot with a respective first mesh portion and second mesh portion.

12. The method according to claim 1, wherein the inflatable element is shaped to match and be placed on an upper zone of a chest of the American football player.

13. The method according to claim 1, wherein the inflatable member comprises a pressure sensor configured to control pressure inside the inflatable element.

14. The method according to claim 13, further comprising alerting the American football player when the pressure inside the inflatable element is insufficient for protection.

15. A method of operating an inflatable member to be worn by an American football player, comprising:

keeping the inflatable member in an inflated condition during use, the inflatable member acting as a protector without plate armor or plates in said inflated condition, said inflatable element configured to assume a curved configuration with its concavity facing the American football player, wherein i) the inflatable element includes a first face having a lesser expansion capacity and lesser yielding capacity on a side facing the American football player, and an opposite second face having a greater expansion capacity and greater yielding capacity on an opposite side to the American football player, wherein the lesser yielding capacity of the first face with respect to the yielding capacity of the second face, a plurality of tie members distributed inside an inner chamber, a first wall and a second wall opposite each other and connected along a perimeter, a first mesh portion, wherein the first mesh portion internally lines at least partially said first wall, and a second mesh portion, wherein the second mesh portion internally lines at least partially said second wall, ii) said tie members have ends fixed to said first mesh portion and to said second mesh portion, iii) said first mesh portion and the first wall at least partially define the second face of the inflatable element and iv) said second mesh portion and the second wall at least partially define said first face of the inflatable element: wherein the inflatable element includes a knitted body, said knitted body having a structure closed on at least four sides, and said first mesh portion and said second mesh portion are part of said knitted body.

16. The method of claim 15, wherein said second wall has said lesser expansion capacity and lesser yielding capacity and said first wall has said greater expansion capacity and greater yielding capacity or vice versa.

* * * * *